US009089184B1

(12) United States Patent
Kiser et al.

(10) Patent No.: US 9,089,184 B1
(45) **Date of Patent: *Jul. 28, 2015**

(54) SANDAL WITH FORMED HINGE AND METHOD OF USE

(71) Applicants: Mary Kiser, West Hollywood, CA (US); Allen D. Hertz, Boca Raton, FL (US)

(72) Inventors: Mary Kiser, West Hollywood, CA (US); Allen D. Hertz, Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/044,808

(22) Filed: Oct. 2, 2013

Related U.S. Application Data

(60) Division of application No. 12/757,998, filed on Apr. 10, 2010, now abandoned, which is a continuation-in-part of application No. 11/518,830, filed on Sep. 11, 2006, now Pat. No. 7,694,435.

(51) Int. Cl.
*A43B 3/24* (2006.01)

(52) U.S. Cl.
CPC ..... *A43B 3/248* (2013.01)

(58) Field of Classification Search
CPC ..... A43B 3/248
USPC ..... 36/11.5, 102, 25 R, 97
See application file for complete search history.

(56) References Cited

U.S. PATENT DOCUMENTS

| | | | | |
|---|---|---|---|---|
| 2,924,029 | A | 2/1960 | Rosen | |
| 4,507,879 | A | 4/1985 | Dassler | |
| 4,967,491 | A | 11/1990 | Plotkin | |
| 5,678,327 | A | 10/1997 | Halberstadt | |
| 5,694,706 | A | 12/1997 | Penka | |
| 6,115,945 | A | 9/2000 | Ellis, III | |
| 6,189,239 | B1 | 2/2001 | Gasparovic et al. | |
| 6,412,196 | B1 | 7/2002 | Gross | |
| 6,836,976 | B2 | 1/2005 | Haugland | |
| 6,990,755 | B2 | 1/2006 | Hatfield et al. | |
| 7,032,327 | B1 | 4/2006 | Tartaglia et al. | |
| 7,168,190 | B1 * | 1/2007 | Gillespie | 36/102 |
| 7,284,341 | B2 | 10/2007 | Moseley | |
| 7,430,817 | B2 | 10/2008 | Abadjian et al. | |
| 7,437,838 | B2 | 10/2008 | Nau | |
| 7,448,148 | B2 | 11/2008 | Martinez et al. | |
| 2007/0204483 | A1 * | 9/2007 | Kirsch et al. | 36/11.5 |

* cited by examiner

*Primary Examiner* — Ted Kavanaugh
(74) *Attorney, Agent, or Firm* — Allen D. Hertz, P.A.; Allen D. Hertz

(57) ABSTRACT

A pair of foldable footwear, each footwear incorporating a flexible hinge within a sole of the footwear. The flexible hinge consists of a molded flexible hinge section 40, a molded hinge aperture 38, a hinge top slot 34 and a hinge limitation contact section 42. The molded flexible hinge section 40 and molded hinge aperture 38 provides a flexible and reliable member allowing the sole to be folded. The sole can comprise a hinge section along a transverse orientation or a longitudinal orientation about the center of the sole. The hinge limitation contact section 42 ensures that a heel section of the sole remains in a wearable configuration during use.

20 Claims, 8 Drawing Sheets

SANDAL WITH FORMED HINGE AND METHOD OF USE

RELATED US PATENT APPLICATIONS

This is a Divisional United States Non-Provisional Utility Patent Application, which claims the benefit of United States Non-Provisional Utility patent application Ser. No. 12/757,998, filed on Apr. 10, 2010, which is a Continuation-In-Part Application of Non-Provisional application Ser. No. 11/518,830 filed on Sep. 11, 2006 (Now issued as U.S. Pat. No. 7,694,435 on Apr. 13, 2010), which are incorporated in their entireties by reference herein.

FIELD OF THE INVENTION

The present invention relates generally to footwear, more specifically, a footwear item that incorporates a formed hinge allowing the footwear to be folded for storage.

BACKGROUND OF THE INVENTION

People wear footwear to protect their feet from hazards, heat, and other items when walking. Flip Flops are one form of footwear, generally a style of footwear that is associated with a more causal environment. Further, that style of footwear is conducive to being a carry along type of item for such scenarios as a trip to the beach, where the flip flops would only be worn at the destination and packed during travel.

Tartaglia, et al. teaches, in U.S. Pat. No. 7,032,327, footwear that is collapsible. Tartaglia, et al. teaches a footwear comprising an intermediate portion includes sufficient flexibility to significantly reduce the size of the sandal by folding the sole into a stored orientation defined by the front and rear portions disposed in at least partially overlying relation to one another. The design of the intermediate portion of Tartaglia, et al. is limited in that the fold section is not a favorable and reliable hinge design. Further, as said intermediate section continues to flex, not only will the flexible section allow the sole to collapse as designed, but it will also allow the heel section of the sole to hang downward when walking causing potential injury to the wearer and excessive wear to the heel section of the footwear.

What is desired is inexpensive footwear that is foldable for storage. Further desired is a foldable mechanism that is reliable and ensures the heel section of the footwear remains in a planar configuration when worn.

SUMMARY OF THE INVENTION

Accordingly, the present invention provides an apparatus for wearing on a person's feet, more specifically foldable footwear. The footwear incorporates a hinge for folding said footwear into a more compact shape for storage.

A first aspect of the present invention is a flip flop style of footwear.

A second aspect of the present invention is a flip flop style of footwear with a foldable section.

A third aspect of the present invention is a flip flop style of footwear with a foldable section, wherein said foldable section provides a hinge that is transverse to the flip flop.

A fourth aspect of the present invention is a flip flop style of footwear with a foldable section, wherein said foldable section provides a hinge that is longitudinally to the flip flop.

A fifth aspect of the present invention is a flip flop style of footwear with two foldable sections, wherein said foldable sections provides a first hinge that is transverse to the flip flop and a second hinge that is longitudinally to the flip flop.

A sixth aspect of the present invention is a hinge design wherein said hinge is molded into a sole of the flip flop.

A seventh aspect of the present invention is a hinge design wherein said hinge is molded into the sole of the flip flop, wherein said hinge comprising an aperture or slot along the length of the hinge.

An eighth aspect of the present invention is a hinge design wherein said hinge is molded into the sole of the flip flop, wherein said hinge comprising a limit feature to ensure that the sole of the flip flop remains planar in a worn configuration.

A ninth aspect of the present invention is a hinge design wherein said hinge is molded into the sole of the flip flop, wherein said hinge comprising a limit feature to ensure that the sole of the flip flop remains planar in a worn configuration, wherein said limit feature further comprising a contact point.

A tenth aspect of the present invention is wherein said hinge is of a symmetric design.

An eleventh aspect of the present invention is a hinge upper clearance section.

A twelfth aspect of the present invention is an upper shoe section for removably coupling said flip flop to a wearer's foot.

A thirteenth aspect of the present invention is wherein said hinge sections are oriented approximately at the center of the footwear.

A fourteenth aspect of the present invention is wherein said hinge sections are oriented approximately at the center of the footwear and in a transverse orientation.

A fifteenth aspect of the present invention is wherein said hinge sections are oriented approximately at the center of the footwear and in a longitudinal orientation.

A sixteenth aspect of the present invention is the inclusion of a storage bag for said footwear.

A seventeenth aspect of the present invention is the inclusion of a storage bag for said footwear, wherein said bag is sized to store said footwear in a folded configuration.

An eighteenth aspect of the present invention incorporates the transverse hinged sole into any footwear form factor.

A nineteenth aspect of the present invention incorporates the transverse hinged sole into a boot.

A twentieth aspect of the present invention incorporates the transverse hinged sole into a casual shoe.

A twenty-first aspect of the present invention incorporates the transverse hinged sole into a flat.

A twenty-second aspect of the present invention incorporates the transverse hinged sole into a slipper.

The disclosed aspects of the present invention define each aspect individually, wherein it is understood that each of the aspects can be combined to provide various embodiments of a foldable flip flop.

BRIEF DESCRIPTION OF THE DRAWINGS

The present invention, together with further objects and advantages thereof may best be understood by reference to the following description taken in conjunction with the accompanying drawings in which.

Various like features are shown throughout the drawings. It is recognized that the features described for a transverse hinge can be applied to a longitudinal hinge.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
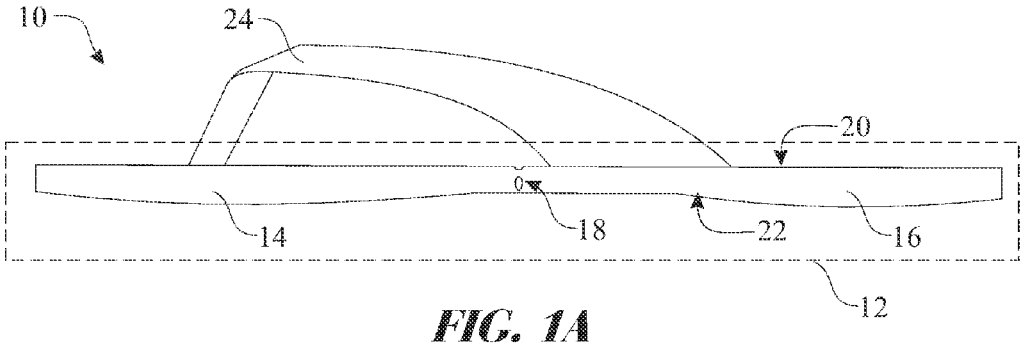
FIG. 1A presents a side view of a flip flop incorporating the present invention.
Figure 1B:
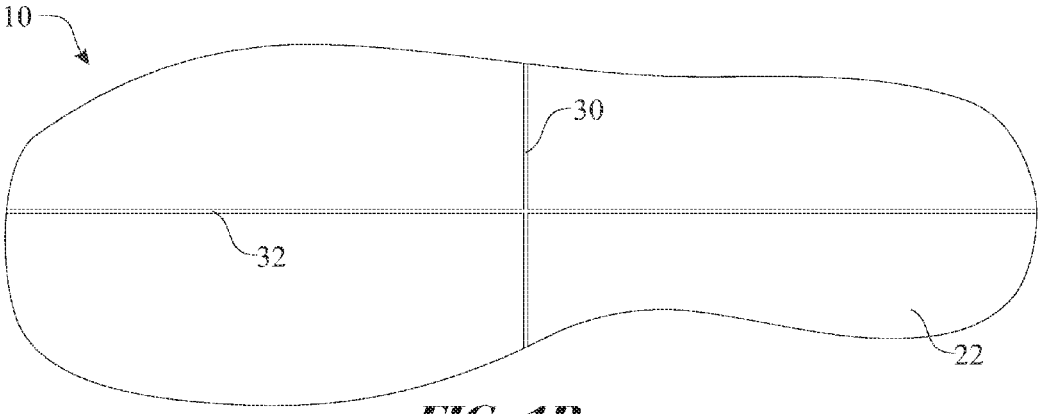
FIG. 1B presents a bottom view of a flip flop incorporating the present invention.
Figure 1C:
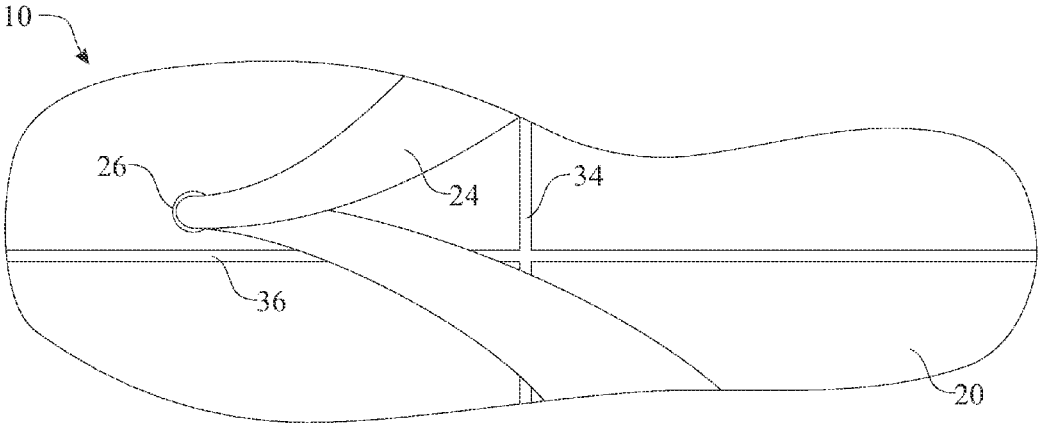
FIG. 1C presents a top view of a flip flop incorporating the present invention.

FIG. 1 presents various orientations of a foldable flip flop 10, including a side view as illustrated in FIG. 1A, a bottom view as illustrated in FIG. 1B and a top view as illustrated in FIG. 1C. Said foldable flip flop 10 comprising a flip flop sole with molded hinge 12 and a flip flop upper strap member 24. Said flip flop sole with molded hinge 12 is a single, molded sole that is generally fabricated of molded rubber. Said flip flop upper strap member 24 is assembled to said flip flop sole with molded hinge 12 to provide an upper member for coupling said foldable flip flop 10 to a wearer's foot (not shown). Said flip flop upper strap member 24 couples to said foldable flip flop 10 at a midpoint via a upper front securing aperture 26. Said flip flop upper strap member 24 can be of a woven canvas, molded plastic, molded rubber, leather, and the like. It is recognized that jewels and other decorative items can be added to said flip flop upper strap member 24. Various features of said foldable flip flop 10 comprise a sole toe section 14 and a sole heel section 16. Additionally introduced are a foot contact surface 20 and a ground contact surface 22. Said foldable flip flop 10 incorporates a molded hinge section 18. Several features respective to said molded hinge section 18 located on the ground contact surface 22 of said foldable flip flop 10 include a transverse hinge stop contact section 30 and a longitudinal hinge stop contact point 32. Further, features respective to said molded hinge section 18 located on the foot contact surface 20 of said foldable flip flop 10 include a transverse hinge top slot 34 and a longitudinal hinge top slot 36.

Figure 2A:
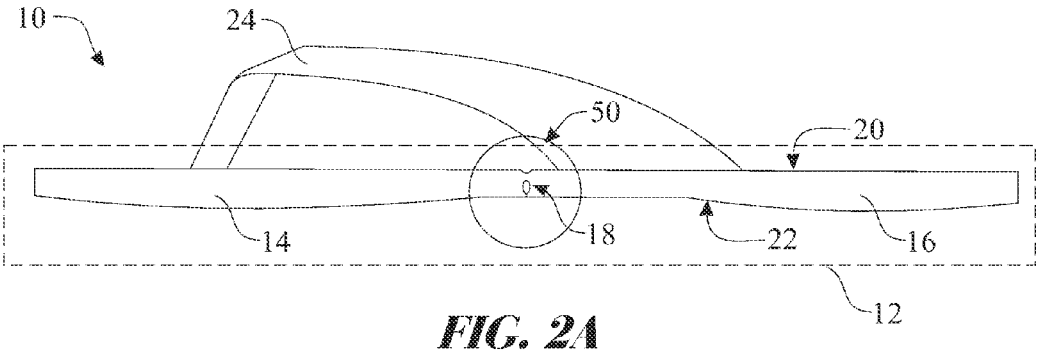
FIG. 2A presents a side view of a flip flop incorporating the present invention, further detailing a moldable hinge section.
Figure 2B:
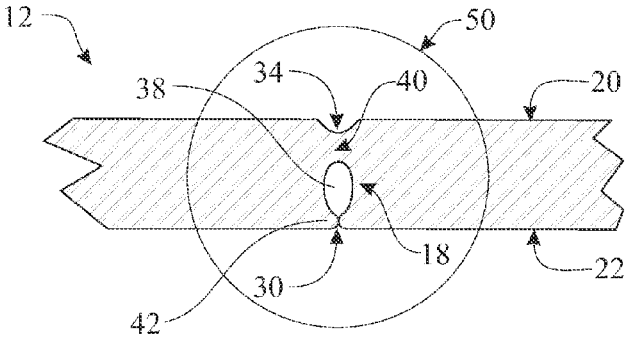
FIG. 2B presents a enlarged side view of a section of the flip flop incorporating the present invention, shown in a planar configuration.
Figure 2C:
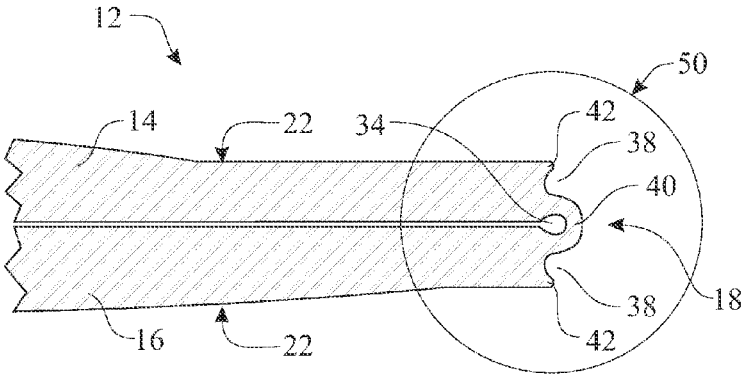
FIG. 2C presents a enlarged side view of a section of the flip flop incorporating the present invention, shown in a folded configuration.

FIG. 2 presents a more detailed illustration of said molded hinge section 18 shown in both a wearable state as illustrated in FIG. 2B and a stored state as illustrated in FIG. 2C. FIG. 2A illustrates said foldable flip flop 10 of FIG. 1, further presenting said enlarged detailed hinge section 50, wherein said enlarged detailed hinge section 50 is to illustrate said molded hinge section 18 in more detail. FIG. 2B illustrates said molded hinge section 18 in a wearable configuration, wherein said molded hinge section 18 comprising said transverse hinge stop contact section 30 and said transverse hinge top slot 34 as introduced in FIG. 1. Said molded hinge section 18 incorporates a flexible hinge slot 38 and a molded flexible hinge section 40 which combined provide a flexible cross section of said molded hinge section 18. Said transverse hinge top slot 34 is a recess incorporated to reduce any bulging or creasing of the material of said flip flop sole with molded hinge 12, wherein when said flip flop sole with molded hinge 12 is folded as shown in FIG. 2C. Without said transverse hinge top slot 34, the material of said flip flop sole with molded hinge 12 would bulge or crease along said foot contact surface 20. Said flexible hinge slot 38 provides a reduced cross sectional area about said molded hinge section 18, thus creating a more flexible section about said molded flexible hinge section 40. To ensure that said sole heel section 16 does not droop when a wearer is wearing and walking in said foldable flip flop 10, the present invention incorporates an inventive footwear hinge limitation contact section 42. Said hinge limitation contact section 42 is presented as a ridge that runs generally parallel to said molded hinge section 18. It is preferred that said hinge limitation contact section 42 is incorporated into said molded hinge section 18 as a pair, one said hinge limitation contact section 42 associated on a sole toe section 14 side and an opposing said hinge limitation contact section 42 associated on a sole heel section 16 side wherein said hinge limitation contact section 42 contact along said transverse hinge stop contact section 30. Said hinge limitation contact section 42 provides a feature of said molded hinge section 18 that maintains said flip flop sole with molded hinge 12 in a normal state when worn, ensuring that said sole heel section 16 section does not flex downward towards the ground when said foldable flip flop 10 is worn. It is recognized that other form factors can be incorporated to provide the same features as said hinge limitation contact section 42 as illustrated. FIG. 2C illustrates said foldable flip flop 10 in a stored orientation. When storing said foldable flip flop 10, the user would fold said foldable flip flop 10 as illustrated contacting along said foot contact surface 20 and having said ground contact surface 22 on the outer or exposed side of the fold. The illustration presents the benefit of said transverse hinge top slot 34 as well as the flexibility of said molded flexible hinge section 40 resulting from the area reduced by the incorporation of said flexible hinge slot 38.

It is recognized that the features are illustrated respective to a hinge that is oriented transverse to said flip flop sole with molded hinge 12, the same features are incorporated in a hinge that is oriented longitudinal to said flip flop sole with molded hinge 12, such as along said longitudinal hinge stop contact point 32 and said longitudinal hinge top slot 36 presented in FIG. 1.

Figure 3:
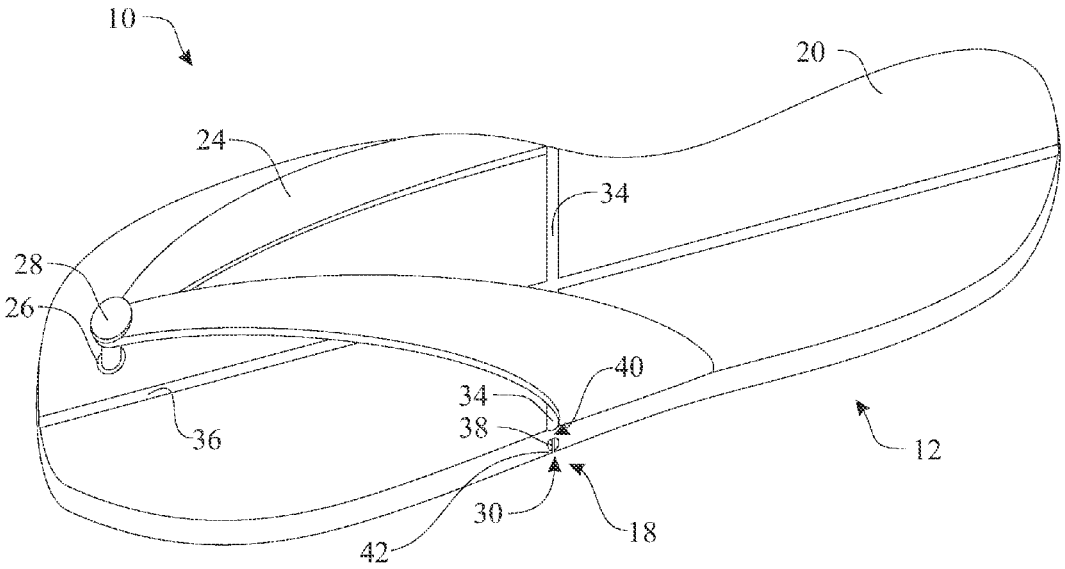
FIG. 3 presents an isometric view of a flip flop incorporating the present invention.

FIG. 3 illustrates an isometric view of said foldable flip flop 10, presented for additional clarity of the present invention. One alternate embodiment of said flip flop upper strap member 24 is illustrated wherein said flip flop upper strap member 24 comprising a pair of straps, wherein each side is secured to said flip flop sole with molded hinge 12 (as understood by FIGS. 1 and 2) and secured at a toe section via a upper front securing member 28 that is coupled to said flip flop sole with molded hinge 12 via said upper front securing aperture 26. The illustration presents said molded hinge section 18 respective to said transverse hinge top slot 34, incorporated transverse to said flip flop sole with molded hinge 12. It is understood that a similar said molded hinge section 18 could optionally be incorporated respective to an optional said longitudinal hinge top slot 36, incorporated longitudinal to said flip flop sole with molded hinge 12.

Figure 4:
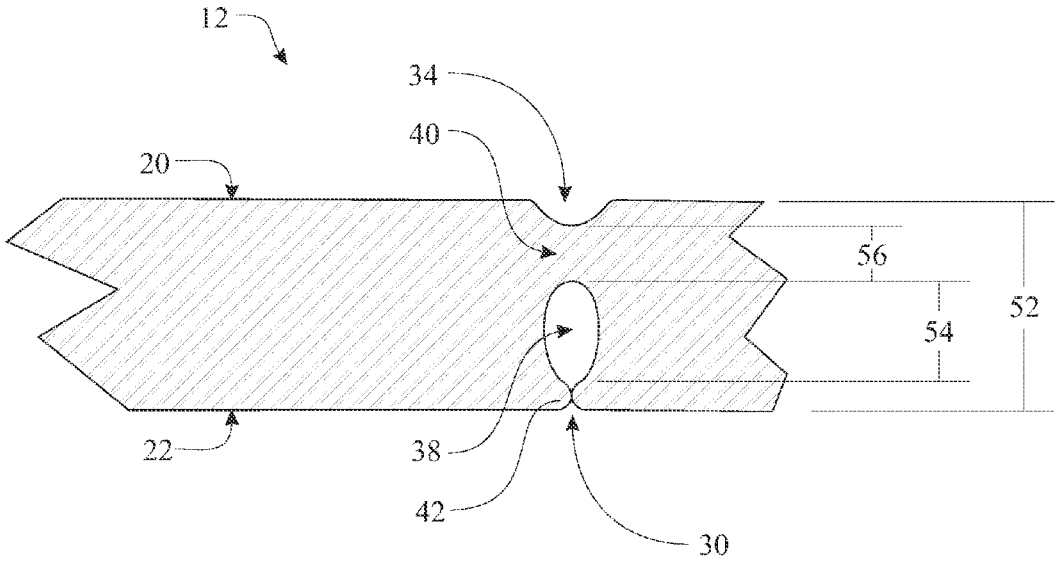
FIG. 4 presents a detailed cross sectional view of the molded hinge section respective to the present invention.

FIG. 4 illustrates said molded hinge section 18, further presenting dimensional properties in conjunction with a preferred embodiment of the present invention. Said flip flop sole with molded hinge 12 would have a thickness of sole thickness at hinge 52 at the region proximate said molded hinge section 18. Said flexible hinge slot 38 would be of a diameter respective to hinge aperture height 54, wherein said hinge aperture height 54 is optimally ⅓ of said sole thickness at hinge 52. Said hinge aperture height 54 can be anywhere between 1/10 of said sole thickness at hinge 52 and ¾ of said sole thickness at hinge 52. Said molded flexible hinge section 40 would have a cross sectional thickness designated by molded flexible hinge section thickness 56, wherein said molded flexible hinge section thickness 56 is optimally ⅓ of said sole thickness at hinge 52. Said molded flexible hinge section thickness 56 can be anywhere between ¼ of said sole thickness at hinge 52 and 9/10 of said sole thickness at hinge 52. Said transverse hinge top slot 34 would have a depth of approximately 1/10 of said sole thickness at hinge 52. Said hinge limitation contact section 42 would have a thickness of the balance of material, approximately ⅓ of said sole thickness at hinge 52.

It is also recognized that the features illustrated respective to the hinge 18 can be inverted, aiding in folding the foldable flip flop 10 in a reverse direction, positioning the ground contact surfaces 22 of the sole toe section 14 and sole heel section 16 against one another. The hinge aperture height 54 would be measured downward from the foot contact surface 20. The transverse hinge top slot 34 would be located on the ground contact surface 22 side of the flip flop sole with molded hinge 12.

Figure 5:
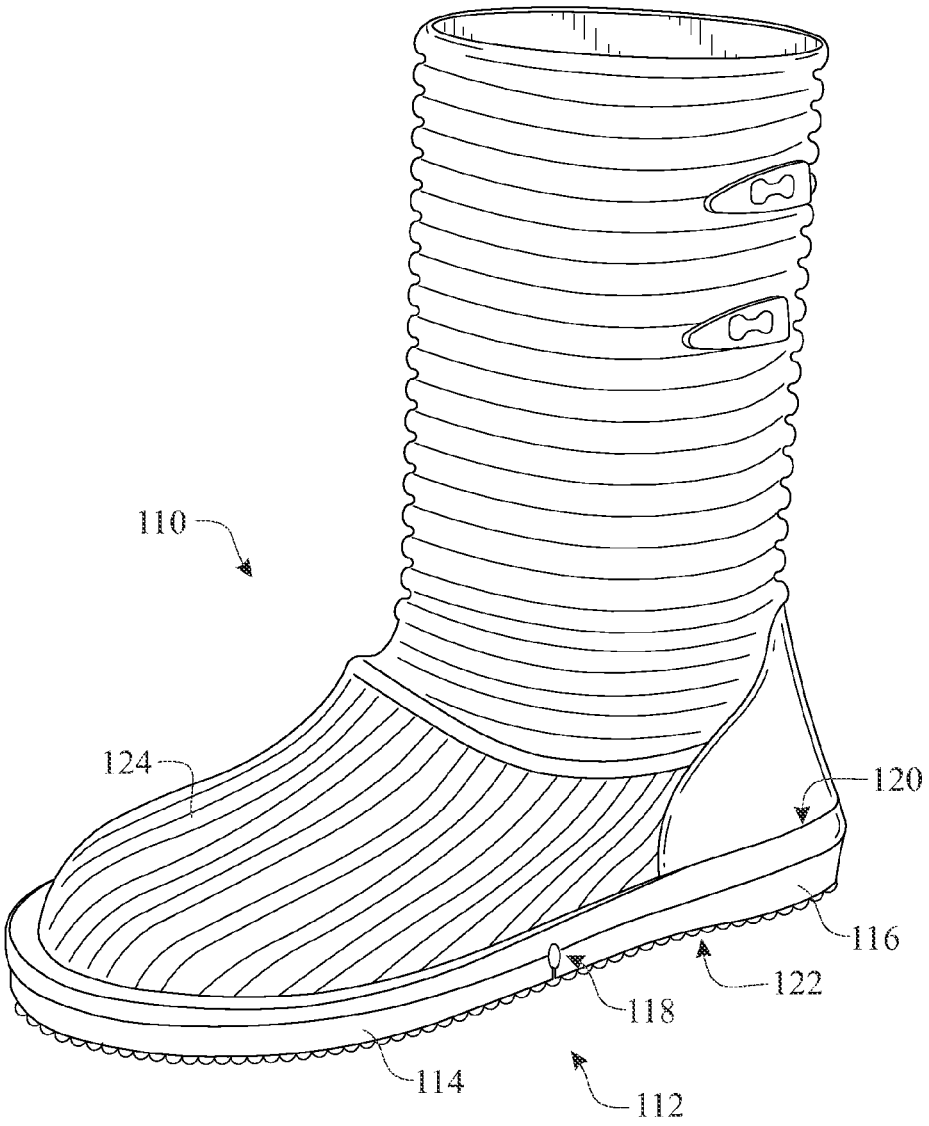
FIG. 5 presents a boot comprising a sole having an integrated transverse molded hinge.

FIG. 5 illustrates an exemplary embodiment of the present invention in a form factor referred to as a folding soled boot 110. The folding soled boot 110 comprises a boot upper section 124 disposed upon to a boot sole with molded hinge 112. The boot upper section 124 is shaped in a form factor having the features of a common boot, including a foot covering and an ankle/lower leg covering extending upwards from the foot covering. The boot upper section 124 is preferably of a soft, flexible material to ensure long term wear of the folding soled boot 110. The boot sole with molded hinge 112 has a lower surface defined as a ground contact surface 122 and an upper surface defined as a foot contact surface 120. The boot sole with molded hinge 112 can be portioned into a sole toe section 114 and a sole heel section 116 being separated by a molded hinge section 118. The molded hinge section 118 is provided in a transverse orientation and shaped having the same dimensions and features as previously presented in FIG. 4. This configuration offers the shoe owner the ability to fold the folding soled boot 110 for any desired reason, including storage.

Figure 6:
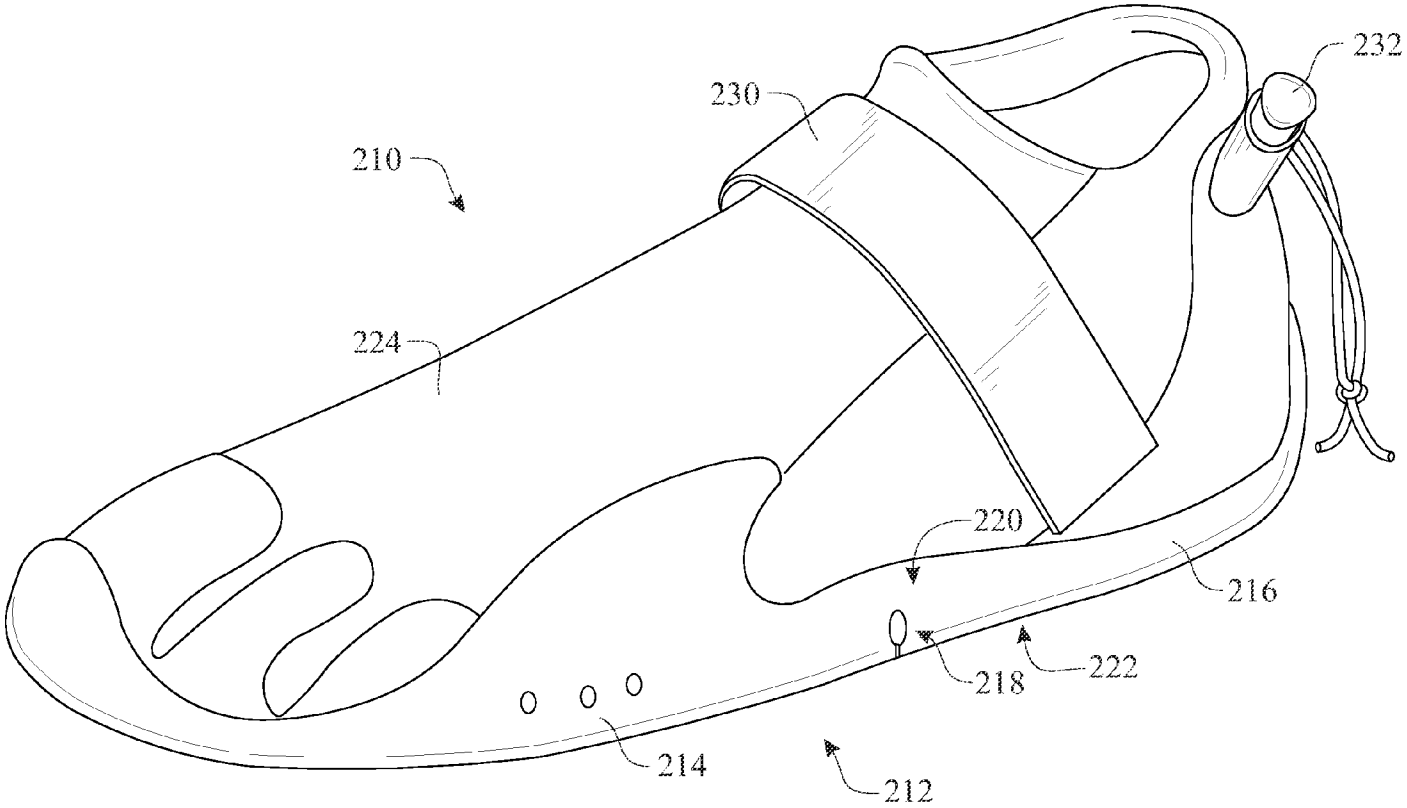
FIG. 6 presents a casual shoe comprising a sole having an integrated transverse molded hinge.

FIG. 6 illustrates an exemplary embodiment of the present invention in a form factor referred to as a folding soled casual shoe 210. The folding soled casual shoe 210 comprises a casual shoe upper section 224 disposed upon to a casual shoe sole with molded hinge 212. The casual shoe upper section 224 is shaped in a form factor having the features of a common casual shoe, including a comfortable foot covering. Some included features may include a strap 230, a tie 232, and the like. The casual shoe upper section 224 is preferably of a soft, flexible material, such as canvas, a woven material, and the like to ensure long term wear of the folding soled casual shoe 210. The casual shoe sole with molded hinge 212 has a lower surface defined as a ground contact surface 222 and an upper surface defined as a foot contact surface 220. The casual shoe sole with molded hinge 212 can be portioned into a sole toe section 214 and a sole heel section 216 being separated by a molded hinge section 218. The molded hinge section 218 is provided in a transverse orientation and shaped having the same dimensions and features as previously presented in FIG. 4. This configuration offers the shoe owner the ability to fold the folding soled casual shoe 210 for any desired reason, including storage.

Figure 7:
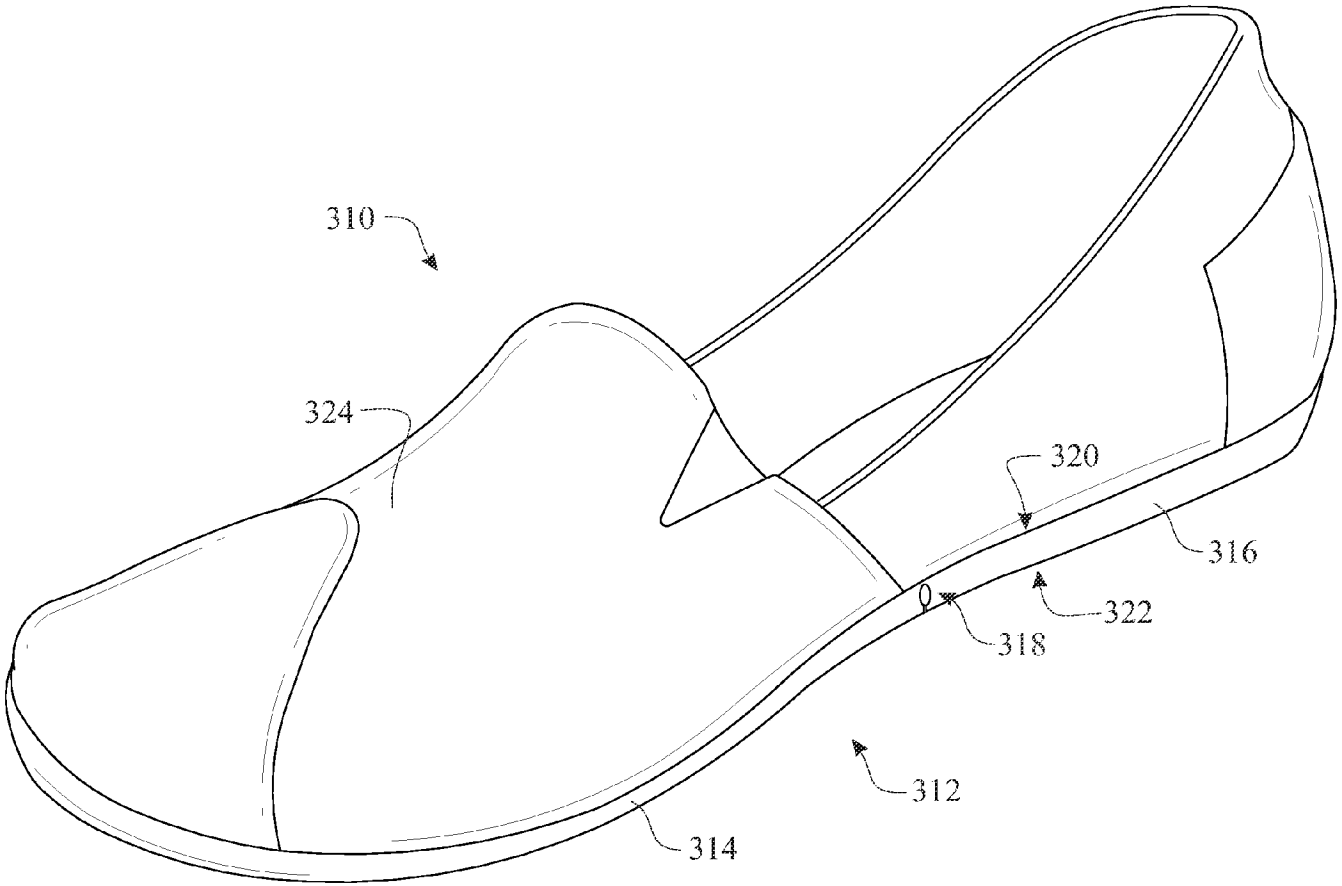
FIG. 7 presents a flat comprising a sole having an integrated transverse molded hinge.

FIG. 7 illustrates an exemplary embodiment of the present invention in a form factor referred to as a folding soled flat 310. The folding soled flat 310 comprises a flat upper section 324 disposed upon to a flat sole with molded hinge 312. The flat upper section 324 is shaped in a form factor having the features of a common flat, including a foot covering generally designed to slip onto the wearer's foot. The flat upper section 324 is preferably of a soft, flexible material, such as canvas, vinyl, cloth, and the like to ensure long term wear of the folding soled flat 310. The flat upper section 324 normally comprises a toe upper section and a heel upper section joined by a section of elastic (not shown). The flat sole with molded hinge 312 has a lower surface defined as a ground contact surface 322 and an upper surface defined as a foot contact surface 320. The flat sole with molded hinge 312 can be portioned into a sole toe section 314 and a sole heel section 316 being separated by a molded hinge section 318. The molded hinge section 318 is provided in a transverse orientation and shaped having the same dimensions and features as previously presented in FIG. 4. This configuration offers the shoe owner the ability to fold the folding soled flat 310 for any desired reason, including storage.

Figure 8:
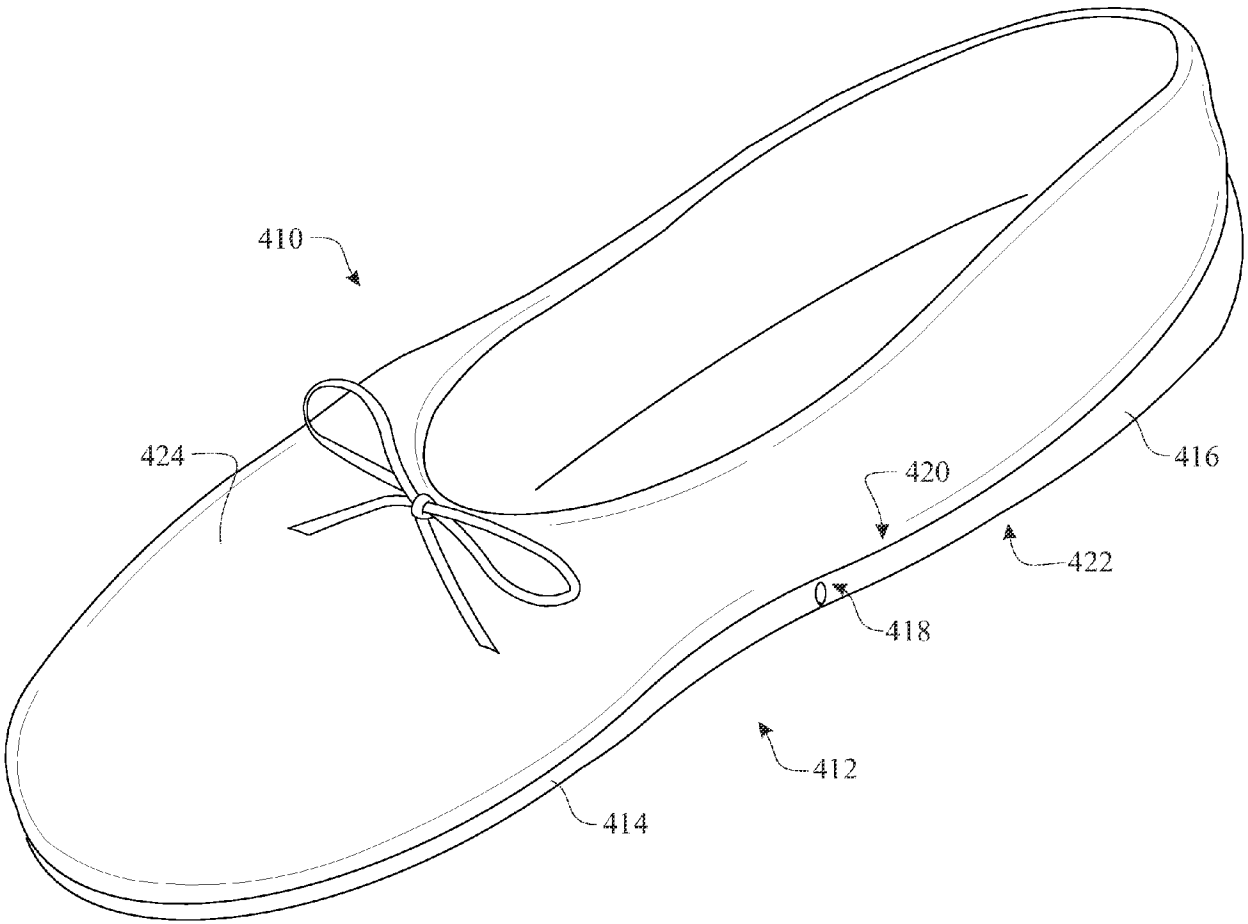
FIG. 8 presents a slipper comprising a sole having an integrated transverse molded hinge.

FIG. 8 illustrates an exemplary embodiment of the present invention in a form factor referred to as a folding soled slipper 410. The folding soled slipper 410 comprises a slipper upper section 424 disposed upon to a slipper sole with molded hinge 412. The slipper upper section 424 is shaped in a form factor having the features of a common slipper, including a foot covering generally designed to slip onto the wearer's foot. The slipper upper section 424 is preferably of a soft, flexible material, such as fleece, and the like to ensure long term wear of the folding soled slipper 410. The slipper upper section 424 normally comprises a toe upper section and a heel upper section joined by a section of elastic (not shown). The slipper sole with molded hinge 412 has a lower surface defined as a ground contact surface 422 and an upper surface defined as a foot contact surface 420. The slipper sole with molded hinge 412 can be portioned into a sole toe section 414 and a sole heel section 416 being separated by a molded hinge section 418. The molded hinge section 418 is provided in a transverse orientation and shaped having the same dimensions and features as previously presented in FIG. 4. This configuration offers the shoe owner the ability to fold the folding soled slipper 410 for any desired reason, including storage.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed:

1. A method of using and storing foldable footwear, the method comprising steps of:

obtaining a pair of foldable footwear, each foldable footwear comprising:

a molded sole having a central sole thickness defined as a dimension between a foot contact surface of the sole and a ground contact surface of the sole proximate a transverse center line of the sole provided having a transverse orientation of the sole;

an upper section for securing one's foot to said foldable footwear, the upper section being disposed upon the foot contact surface of the molded sole and designed to be placed over a wearer's foot; and a hinge molded into the molded sole, said hinge comprising:

a flexible hinge slot extending laterally across the midsection of the sole and extending upward from the ground contact surface of the sole into the sole a distance that is greater than ¼ and less than 9/10 of the central sole thickness, the hinge defining a toe portion of the molded sole and a heel portion of the molded sole;

a transverse hinge top recess extending laterally across the midsection of the sole and extending downward from the foot contact surface of the sole into the sole wherein the flexible hinge slot and the transverse hinge top recess are in vertical alignment with one another; and folding each of the foldable footwear along the hinge placing the foot contact surface of the mold sole toe portion and the foot contact surface of the molded sole heel portion substantially parallel and opposite one another.

2. A method of using and storing foldable footwear as recited in claim 1, the method further comprising a step of reducing any compression of sole material along the foot contact surface portion of the hinge by providing a hinge top slot provided parallel to said flexible hinge and extending inward from the foot contact surface.

3. A method of using and storing foldable footwear as recited in claim 1, the method further comprising a step of reducing any compression of sole material along the foot contact surface portion of the hinge by providing a hinge top slot provided parallel to said flexible hinge and extending inward from the foot contact surface by a dimension that is up to 1/10 of the central sole thickness.

4. A method of using and storing foldable footwear as recited in claim 1, wherein the step of folding each of the foldable footwear along the hinge placing the foot contact surface of the mold sole toe portion and the molded sole heel portion substantially parallel and opposite one another causes the mold sole toe portion and the molded sole heel portion to contact one another.

5. A method of using and storing foldable footwear as recited in claim 1, the method further comprising a step of engaging sole ends of walls defining the flexible hinge slot with one other, thus limiting a folding motion of the molded sole when folding the foldable footwear in a direction that would orient the ground contacting surface of each of the mold sole toe portion and the molded sole heel portion towards one another, thus retaining the molded sole in a generally planar, wearable configuration.

6. A method of using and storing foldable footwear as recited in claim 1, the method further comprising steps of:

orienting the pair of foldable footwear in a wearable configuration by expanding the mold sole toe portion and the molded sole heel portion into a generally planar configuration; and orienting the pair of foldable footwear in a storage configuration by accomplishing the step of folding each of the foldable footwear along the hinge placing the foot contact surface of the mold sole toe portion and the molded sole heel portion substantially parallel and opposite one another.

7. A method of using and storing foldable footwear as recited in claim 1, the method further comprising a step of placing the pair of folded foldable footwear into a bag.

8. A method of using and storing foldable footwear, the method comprising steps of:

obtaining a pair of foldable footwear, each foldable footwear comprising:

a molded sole having a central sole thickness defined as a dimension between a foot contact surface of the sole and a ground contact surface of the sole proximate a transverse center line of the sole provided having a transverse orientation of the sole;

an upper section for securing one's foot to said foldable footwear, the upper section comprising an upper strap member, wherein a first end of the upper strap member is attached to the sole proximate a respective first edge, a second, opposite end of the upper strap member is attached to the sole proximate a respective second, opposite edge and a central point attached to a central toe section located substantially forward of the first and section ends, wherein the central point is attached to a central toe section by a upper front securing member, forming a sandal-shaped configuration; and a hinge molded into the molded sole, said hinge comprising:

a flexible hinge slot extending laterally across the midsection of the sole and extending upward from the ground contact surface of the sole into the sole a distance that is greater than ¼ and less than 9/10 of the central sole thickness, the hinge defining a toe portion of the molded sole and a heel portion of the molded sole;

a transverse hinge top recess extending laterally across the midsection of the sole and extending downward from the foot contact surface of the sole into the sole wherein the flexible hinge slot and the transverse hinge top recess are in vertical alignment with one another; and folding each of the foldable footwear along the hinge placing the foot contact surface of the mold sole toe portion and the foot contact surface of the molded sole heel portion substantially parallel and opposite one another.

9. A method of using and storing foldable footwear as recited in claim 8, the method further comprising a step of reducing any compression of sole material along the foot contact surface portion of the hinge by providing a hinge top slot provided parallel to said flexible hinge and extending inward from the foot contact surface.

10. A method of using and storing foldable footwear as recited in claim 8, the method further comprising a step of reducing any compression of sole material along the foot contact surface portion of the hinge by providing a hinge top slot provided parallel to said flexible hinge and extending inward from the foot contact surface by a dimension that is up to 1/10 of the central sole thickness.

11. A method of using and storing foldable footwear as recited in claim 8, wherein the step of folding each of the foldable footwear along the hinge placing the foot contact surface of the mold sole toe portion and the molded sole heel portion substantially parallel and opposite one another causes the mold sole toe portion and the molded sole heel portion to contact one another.

12. A method of using and storing foldable footwear as recited in claim 8, the method further comprising a step of engaging sole ends of walls defining the flexible hinge slot with one other, thus limiting a folding motion of the molded sole when folding the foldable footwear in a direction that would orient the ground contacting surface of each of the mold sole toe portion and the molded sole heel portion towards one another, thus retaining the molded sole in a generally planar, wearable configuration.

13. A method of using and storing foldable footwear as recited in claim 8, the method further comprising steps of:

orienting the pair of foldable footwear in a wearable configuration by expanding the mold sole toe portion and the molded sole heel portion into a generally planar configuration; and orienting the pair of foldable footwear in a storage configuration by accomplishing the step of folding each of the foldable footwear along the hinge placing the foot contact surface of the mold sole toe portion and the molded sole heel portion substantially parallel and opposite one another.

14. A method of using and storing foldable footwear as recited in claim 8, the method further comprising a step of placing the pair of folded foldable footwear into a bag.

15. A method of using and storing foldable footwear, the method comprising steps of:

obtaining a pair of foldable footwear, each foldable footwear comprising:

a molded sole having a central sole thickness defined as a dimension between a foot contact surface of the sole and a ground contact surface of the sole proximate a transverse center line of the sole provided having a transverse orientation of the sole;

an upper section for securing one's foot to said foldable footwear, the upper section being disposed upon the foot contact surface of the molded sole and designed to be placed over a wearer's foot; and a hinge molded into the molded sole, said hinge comprising:

a flexible hinge slot extending laterally across the midsection of the sole and extending downward from the foot contact surface of the sole into the sole a distance that is greater than 1/4 and less than 9/10 of the central sole thickness, the hinge defining a toe portion of the molded sole and a heel portion of the molded sole;

a transverse hinge top recess extending laterally across the midsection of the sole and extending downward from the foot contact surface of the sole into the sole wherein the flexible hinge slot and the transverse hinge top recess are in vertical alignment with one another; and folding each of the foldable footwear along the hinge placing the ground contact surface of the mold sole toe portion and the ground contact surface of the molded sole heel portion substantially parallel and opposite one another.

16. A method of using and storing foldable footwear as recited in claim 15, the method further comprising a step of reducing any compression of sole material along the ground contact surface portion of the hinge by providing a hinge bottom slot provided parallel to said flexible hinge and extending inward from the ground contact surface.

17. A method of using and storing foldable footwear as recited in claim 15, the method further comprising a step of reducing any compression of sole material along the ground contact surface portion of the hinge by providing a hinge bottom slot provided parallel to said flexible hinge and extending inward from the ground contact surface by a dimension that is up to 1/10 of the central sole thickness.

18. A method of using and storing foldable footwear as recited in claim 15, wherein the step of folding each of the foldable footwear along the hinge placing the foot contact surface of the mold sole toe portion and the molded sole heel portion substantially parallel and opposite one another causes the mold sole toe portion and the molded sole heel portion to contact one another.

19. A method of using and storing foldable footwear as recited in claim 15, wherein the step of obtaining the pair of foldable footwear is further refined by obtaining a pair of foldable footwear, each upper section of the foldable footwear further comprises a an upper strap member, wherein a first end of the upper strap member is attached to the sole proximate a respective first edge, a second, opposite end of the upper strap member is attached to the sole proximate a respective second, opposite edge and a central point attached to a central toe section located substantially forward of the first and section ends, wherein the central point is attached to a central toe section by a upper front securing member, forming a sandal-shaped configuration.

20. A method of using and storing foldable footwear as recited in claim 15, the method further comprising a step of placing the pair of folded foldable footwear into a bag.

* * * * *